US005475190A

United States Patent [19]

Smith et al.

[11] Patent Number: 5,475,190

[45] Date of Patent: Dec. 12, 1995

[54] OPERATOR OF A HANDLE OR TOGGLE OF A SWITCH

[75] Inventors: George A. Smith, N. Huntingdon; Thomas K. Fogle, Pittsburgh, both of Pa.; Mark L. Lotzmann, London, Ky.

[73] Assignee: Eaton Corporation, Cleveland, Ohio

[21] Appl. No.: 228,028

[22] Filed: Apr. 15, 1994

[51] Int. Cl.[6] ..... H01H 3/20

[52] U.S. Cl. ..... 200/50 R; 200/17 R; 200/330

[58] Field of Search ..... 200/17 R, 18, 200/1 R, 50 R, 50 C, 329, 330, 331, 332.1, 332.2, 33 R–41; 307/64–80

[56] References Cited

U.S. PATENT DOCUMENTS

| | | | |
|---|---|---|---|
| 2,431,387 | 11/1947 | Florenza | 16/114 A |
| 2,937,247 | 5/1960 | Laviana et al. | 200/38 A |
| 3,179,758 | 4/1965 | Trock | 200/38 FB X |
| 3,236,967 | 2/1966 | Bottonari et al. | 335/69 |
| 3,652,815 | 3/1972 | Davies | 200/400 |
| 3,689,721 | 9/1972 | Mc Guffie | 200/400 |
| 3,773,995 | 11/1973 | Davies | 200/400 |
| 3,778,633 | 12/1973 | DeVisser et al. | 307/64 |
| 3,800,114 | 3/1974 | Strobel | 200/330 |
| 3,806,684 | 4/1974 | Hauser | 200/400 |
| 3,818,156 | 6/1974 | Augustyniak | 200/33 R |
| 4,021,678 | 5/1977 | Moakler et al. | 307/64 |
| 4,110,582 | 8/1978 | Barkan | 200/400 |
| 4,146,764 | 3/1979 | Wilson | 200/400 |
| 4,163,133 | 7/1979 | Bould | 200/400 |
| 4,167,988 | 9/1979 | Acampora et al. | 185/40 R |
| 4,270,031 | 5/1981 | Borona et al. | 200/50 C |
| 4,286,242 | 8/1981 | Mrenna et al. | 335/160 |
| 4,295,054 | 10/1981 | Kovatch et al. | 307/80 |
| 4,359,611 | 11/1982 | Haskins | 200/1 TK |
| 4,398,097 | 8/1983 | Schell et al. | 307/64 |
| 4,404,446 | 9/1983 | Maier et al. | 200/320 |
| 4,409,449 | 10/1983 | Takano et al. | 200/400 |
| 4,423,336 | 12/1983 | Iverson et al. | 307/64 |
| 4,510,357 | 4/1985 | Winterbottom | 200/50 R |
| 4,523,769 | 6/1985 | Glaser et al. | 280/252 |
| 4,575,592 | 3/1986 | Rose | 200/6 R |
| 4,587,390 | 5/1986 | Gray | 200/400 |
| 4,596,310 | 6/1986 | Hatakeyama et al. | 185/40 R |
| 4,672,227 | 6/1987 | Lagree et al. | 307/64 |
| 4,681,988 | 7/1987 | Hodkin et al. | 200/17 R |
| 4,742,200 | 5/1988 | Marquardt et al. | 200/325 |
| 4,747,061 | 5/1988 | Lagree et al. | 364/483 |
| 4,760,278 | 7/1988 | Thomson | 307/64 |
| 4,791,255 | 12/1988 | Eliezer | 200/144 R |
| 4,827,089 | 5/1989 | Morris et al. | 200/50 C |
| 4,894,796 | 6/1990 | Engel et al. | 395/275 |
| 4,902,859 | 2/1990 | Witzmann et al. | 200/50 C |
| 4,924,041 | 5/1990 | Yee | 200/50 C |
| 4,999,598 | 3/1991 | Jannesari | 335/122 |
| 5,081,367 | 1/1992 | Smith et al. | 307/64 |
| 5,219,070 | 6/1993 | Grunert et al. | 200/330 |
| 5,397,868 | 3/1995 | Smith et al. | 200/18 |

*Primary Examiner*—J. R. Scott
*Attorney, Agent, or Firm*—Martin J. Moran

[57] ABSTRACT

A powered mechanism displaces the toggle, handle or similar operator of a switch such as a circuit breaker, motor contactor or transfer switch. A linear induction motor drives a motor shaft between extended and retracted positions. A pair of S-shaped cam members pivot at one end on an axis, and a sliding pin carried on the end of the motor shaft rides along slots in the cam members. A couple engages over the switch operator and is pivotally attached to links that in turn are pivotally attached to the cam members, The links attach to the cam members at a point closer to the pivot axis of the cam member than the sliding pin in the slots, thus obtaining leverage. The slots have an inclined or curved section joined to a straight section. The straight section provides an idling action in that no force is applied to the operator via the couple as the sliding pin passes through the straight section, allowing the motor to accelerate unopposed. When the sliding pin is in the inclined or curved section, displacement of the motor shaft moves the couple, and therefore the switch operator handle.

14 Claims, 2 Drawing Sheets

OPERATOR OF A HANDLE OR TOGGLE OF A SWITCH

BACKGROUND OF THE INVENTION

1. Field of the Invention

The invention relates to a powered actuator for displacing the toggle, handle or other operator of a switch, such as a breaker for an electric power distribution circuit. The actuator includes a driver operable to move a shaft between extended and retracted positions, a couple defining a receptacle that engages over the toggle or handle of the switch, and a mechanism interconnecting the shaft with the couple such that changes in position in the shaft induce changes in position in the toggle or handle via the couple.

The driver can comprise a linear induction motor extending and/or retracting an associated motor shaft in response to control signals, for example from a remote controller operated either manually or by programmable devices. Other forms of drivers are also possible. The mechanism includes a pair of cam members, each defining an enclosed slot. An abutment member is carried by the motor shaft and has portions extending into the enclosed slots. A pair of links are pivotally connected, respectively, to the cam members and to the couple. Each cam member has a mounting-hole spaced from the enclosed slot, and the cam members are pivotally mounted to a stationary support structure for pivoting about a fixed axis that extends through the mounting-holes.

Motion of the abutment member in the enclosed slots causes the cam members to pivot. This pushes or pulls the rigid links, displacing the toggle or handle via the couple and operating the switch.

2. Prior Art

Powered switch actuation devices are known in power distribution applications, for example as means to switch a load circuit between power grids in response to signals sent by a remote controller. The controller can be operated manually or can be responsive to a programmable device. Such switch control devices may be intended to operate heavy duty switches rated for switching formidable loads, such as loads in the hundreds or thousands of volts at thousands of amps. However the devices themselves advantageously are operated at considerably lower power levels, for example, 110 VAC at 12 A, and can be controlled by switching means triggered by signals of much lower power still.

Switch control devices may be configured in single switch configurations (e.g., as in FIGS. 1 and 2 herein), or in plural switch configurations. A dual configuration intended to switch a load circuit from one line circuit to another line circuit is commonly known as a transfer switch, and an example is disclosed in U.S. Pat. No. 5,274,206, granted Dec. 28, 1993, entitled "SPRING CHARGING MECHANISM FOR CIRCUIT BREAKERS AND TRANSFER SWITCHES," by inventor Stanislaw A. Milianowicz, the disclosure of which is hereby incorporated. In a typical application, a transfer switch switches a load circuit from a primary power line or grid to an auxiliary one, or back again. Single switch configurations having one or more poles can be arranged in gangs with other single or multiple switches and actuators for more complex switching schemes, for example where related loads or lines are switched in a coordinated manner.

More generally, single switch configurations are useful for operating a switch via a remote controller and/or for operating the toggles or handles of large circuit breakers. A circuit breaker for high power loads may require 150 to 300 lbs (70 to 140 kg) of force to displace, which force is perhaps too much to manually displace safely without some type of mechanical advantage.

Switch actuators advantageously provide good mechanical advantage for operating the toggle or handle. An important consideration is the manner in which the actuator is powered or driven, and how the driving force is coupled to the toggle or handle. Advantageously, a switch control or actuation device should not unduly complicate the apparatus, should involve a minimal expense to make and use, and should be durable and long-lived. Additionally, the actuator should be compact because space on power distribution panels is relatively valuable.

The concept of mechanical advantage or leverage is to couple a driving stroke to a driven stroke so as to convert the applied force of a relatively longer driving stroke to a higher force over a shorter driven stroke, i.e., the operative displacement of the toggle or handle. Preferably, the resultant force is several times greater than the applied driving force. Known switch control devices are disadvantageous in that they cannot amplify the applied driving force by a significant factor or in an optimal manner. Amplification of the force produced by the actuating driver is desirable because it reduces the electric power level needed to operate a given switch.

It is generally necessary in a lever arrangement for increasing force, to provide a driving stroke that is proportionately longer than the driven stroke, by an amount corresponding to the factor by which the force is to be multiplied. Various lever arrangements are conceivable for operating a switch. However, it would be advantageous if the means or mechanism that amplifies the applied driving force could be kept small, durable, inexpensive and uncomplicated. In connection with actuator mechanisms for switches, it is important that the mechanism have only a small extension in a direction perpendicular to the plane of the panel on which the switch is mounted.

Conventional drivers or motors for switch actuators include rotary electric motors turning either a threaded drive-shaft coupled with a driven nut or a crank pushing and pulling a lever, and pneumatic or hydraulic actuators. According to one aspect of the invention, a linear induction motor is used as the driver of a switch actuator. A linear induction motor provides a high speed straight-line action similar to that of a hydraulic or pneumatic actuator without the complications of the associated hydraulic and pneumatic circuits. According to another aspect, an improved mechanism is coupled to the motor for amplifying the driving force of the motor, providing a reasonably sized, reasonably priced switch actuator that is compact and durable.

SUMMARY OF THE INVENTION

It is an object of the invention to provide a remotely controllable apparatus for actuating or displacing a toggle, handle or similar operator of a switch.

It is another object of the invention to amplify the applied driving force supplied via a driver or motor such that the resultant induced force acting directly on the toggle or handle of the switch is several times greater than the applied force.

It is still another object of the invention to permit an apparatus for operating or displacing the toggle or handle of a given switch to be operated or powered by a lower power driver or motor than is generally possible with the known switch control devices for that given switch.

It is also an object of the invention to provide a switch actuator having a linear driving stroke and a mechanism providing leverage, which extends minimally from the panel on which the switch is mounted.

It is a further object of the invention to employ a cam member with a cam surfaces defining an enclosed slot, and an abutment member engaged in the slot such that changes in position in the abutment member induce corresponding changes in position in the cam member.

It is still a further object of the invention that the above abutment member be powered by a motor extending and retracting a motor shaft in a direction substantially parallel to the actuation stroke of the switch, and in particular by a linear induction motor.

According to another aspect of the invention, the enclosed slot defines an idling section cooperative with the abutment member such that the toggle or handle of the switch idles in place over a portion of the stroke of the motor shaft, to provide for acceleration of the motor shaft leading to actuation of the switch. The slot also has a curved section cooperative with the abutment member such that changes in position in the motor shaft correspondingly changes the position of the toggle or handle of the switch.

The motor shaft attacks the curved section of the slot along such an axis that the motor shaft stroke generally coincides with the local radius of curvature of the curved section, for all orientations of the cam member. Thus, forces perpendicular to the motor shaft are minimized and binding between the motor shaft and motor is minimized.

These and other aspects and objects are provided according to the invention in an apparatus for operating the toggle or handle of a switch such as a molded-case circuit breaker, a molded-case circuit switch, a circuit interrupter and/or a motor contactor. The apparatus is particularly useful as a switch actuator for a power distribution panel, and can be controlled by a remote controller to open and close circuits, or as a transfer switch to operate a pair of opposed switches for switching a power-consuming load back and forth between a primary power supply or grid and an auxiliary power supply or grid.

The apparatus includes a couple defining a receptacle placed over the toggle or handle of the switch. The couple is slidably associated with one or more arcuate slots which define an arcuate movement for the couple complementary to the movement of the toggle or handle of the switch.

A motor supplies a driving force via a retractable motor shaft movable between extended and retracted positions. The motor can be, for instance, a linear induction motor that thrusts and/or pulls a non-rotating motor shaft between the extended and retracted operative positions. Other variations are possible in accordance with the invention. Designers ordinarily skilled in the art may likely prefer, as a matter of routine design choice, a hydraulic or pneumatic actuator, or a rotary motor turning a threaded drive shaft that is coupled to a drive nut, or a rotary motor turning a crank that alternately pushes and pulls a rigid link connected to the couple on the toggle or handle.

A mechanism interconnects the motor shaft with the couple on the toggle or handle of the switch. The mechanism includes a cam member, and preferably a pair of opposite cam members, pivotally connected to a support structure to pivot about a fixed axis. The cam members flank the motor shaft and have matching cam surfaces defining opposite enclosed slots. An abutment member, such as a pin protruding laterally of the motor shaft, is fixed in a socket near an end of the motor shaft, and has opposite end portions slidably disposed in the slots in the cam members. Driving the abutment member through the slot via a driving force supplied by the motor causes the abutment member to bear against the cam surfaces of the cam members to induce the cam members to pivot in one direction or the other. A pair of rigid links pivotally connect the cam members to the couple that engages the toggle or handle. The linear driving force supplied by the motor is converted to an induced force acting on the toggle or handle of the switch.

The rigid links are pivotally connected to the cam members at locations closer to the fixed axis than the line of action of the motor shaft. This supplies leverage such that the mechanism amplifies the driving force, producing a shorter actuation stroke at the couple at a greater force as compared to the longer stroke of the motor shaft. The induced force preferably is several times greater than the driving force, which is advantageous for displacing the toggle or handle of a molded-case circuit breaker or the like, which has such stiff internal springs opposing the movement of the toggle or handle. The invention is thus applicable to actuation of heavy duty circuit breakers and transfer switches, wherein as much as 300 pounds of force may be needed to displace the toggle or handle to actuate the switching contacts.

The slot in the cam members has a straight section joined to an inclined or curved section. The straight section permits an idling action such that the couple on the toggle or handle is not moved during displacement of the abutment member along the straight section of the slot, nor do the cam members resist the displacement of the abutment member along the straight section. This gives the motor time to accelerate the motor shaft before the abutment member enters the inclined section of the slot, where force is applied to the couple.

The abutment member cooperates with the inclined section of the slot such that changes in position in the motor shaft induce correspondingly induces changes in position in the couple on the toggle or handle of the switch. The inclined section can be curved such that the motor shaft attacks the curved section of the slot along such an axis that the motor shaft generally coincides with the local radius of curvature for the curved section, for all orientations of the cam members, so that forces perpendicular to the longitudinal axis of the motor shaft are minimized and binding between the motor shaft and motor is minimized.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
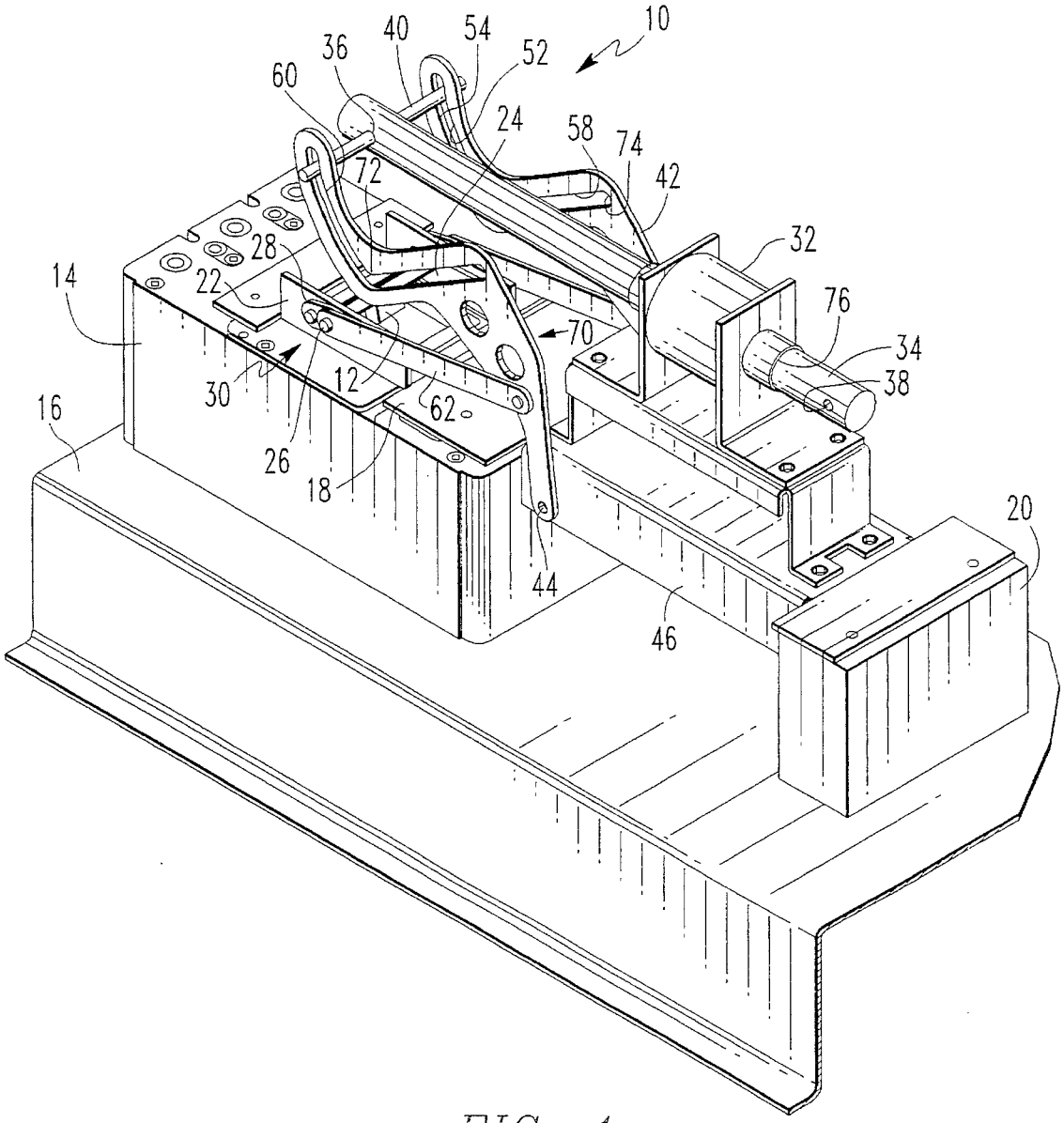
FIG. 1 is a side perspective view of the operator according to the invention, shown operatively controlling or displacing the toggle or handle of a molded-case circuit breaker; and, FIG. 2 is a side elevational view thereof.

In the drawings, an apparatus 10 according to the invention is provided for actuating or displacing the toggle, handle or similar operator 12 of a switch 14, and is mounted on a common support structure 16 with the switch 14. In the drawings, the support structure is horizontal. However, the switch can be mounted in any orientation, and accordingly, terms like "up" and "down", "left" and "right" are used merely for convenience in this description and do not limit the apparatus 10.

Figure 2:
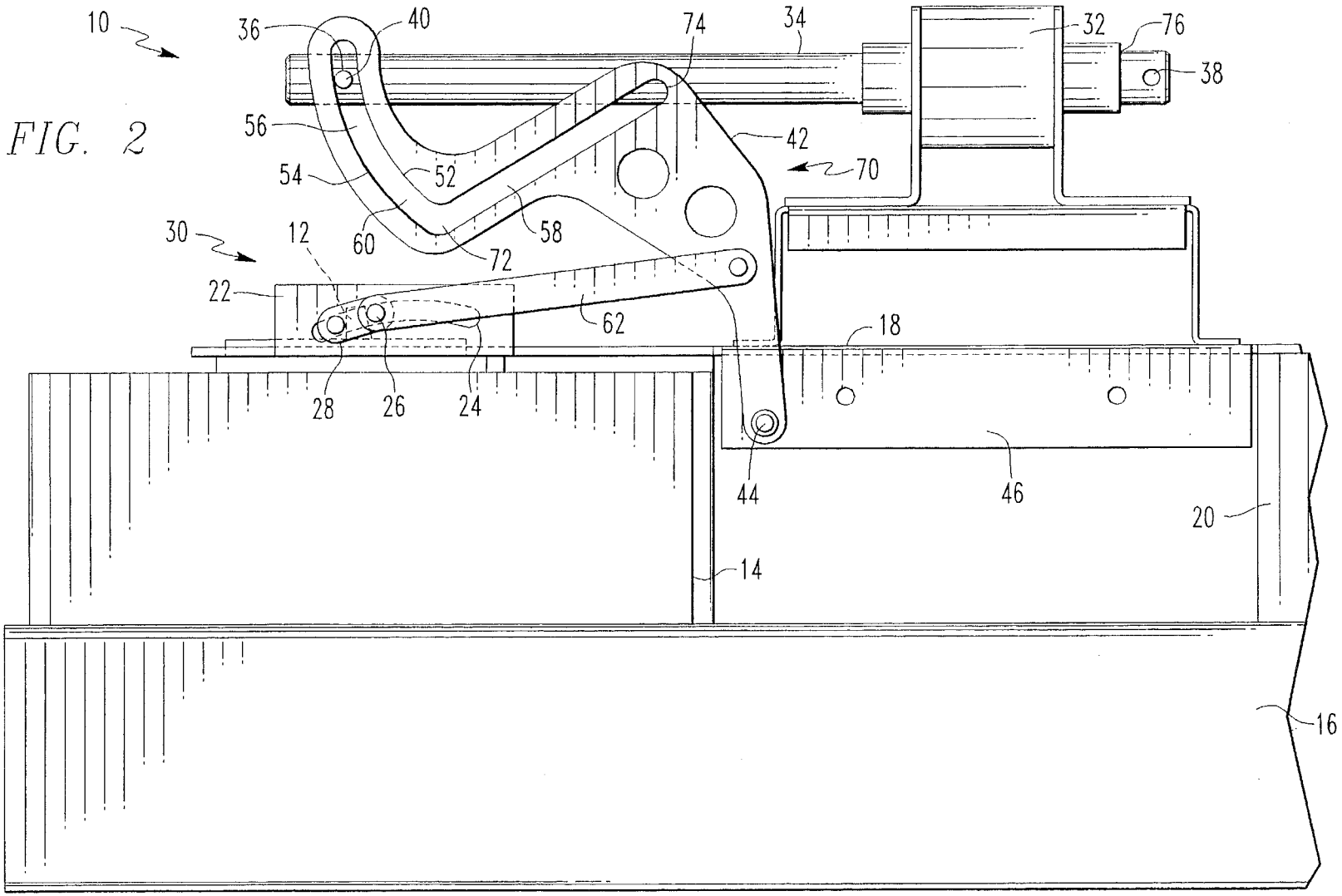

In the exemplary embodiment shown in FIGS. 1 and 2, switch 14 is a molded-case circuit breaker. The invention is also applicable to other types of switches, such as a molded-case circuit switches, circuit interrupters, motor contactors or starters, and the like. In the exemplary embodiment the apparatus 10 according to the invention operates a single toggle or handle 12 of a single switch 14. Alternatively, the apparatus 10 according to the invention can be routinely reconfigured to operate the toggles or handles 12 of a pair of opposed switches, for example with a second switch (not shown) located in mirror opposition relative to the illustrated switch 14 (e.g., to the right in FIG. 2). Such a two switch configuration functions as a transfer switch, of which an exemplary transfer switch is disclosed in copending application Ser. No. 127,919, filed Sep. 28, 1993, entitled "TRANSFER SWITCH MECHANISM", the disclosure of which is hereby incorporated.

The apparatus 10 includes a base plate 18 mounted on the top surface of switch 14. Preferably, base plate 18 is further supported on a spacer block 20, spaced from switch 14 and of the same height as switch 14. In a transfer switch configuration, a second switch would be disposed at the location of spacer block 20 as shown in FIGS. 1 and 2. Base plate 18 includes an opening in one end providing clearance for the toggle or handle 12 of switch 14. The opening is flanked by a pair of upright flanges 22, formed with arcuate slots 24 as shown in FIG. 2, for guiding the sliding movement of a pair of spaced pins 26 slidably disposed in the arcuate slots 24. The spaced pins 26 are fastened together at a fixed spacing by a pair of opposite retainers 28 on the outside of the upright flanges 22 and engage on opposite sides of handle or toggle 12 in the direction of actuation. The spaced pins 26 and arcuate slots 24 cooperate with the toggle or handle 12 in a manner disclosed by the above application entitled "HANDLE ACTUATOR FOR A CIRCUIT INTERRUPTER HANDLE", and define a path of movement for the couple 30 which is complementary to the swinging or pivoting movement of the toggle or handle 12. The invention is also applicable to a sliding toggle movement (not shown), in which event slots 24 can be straight and horizontal.

The base plate 18 supports a bracket carrying a linear induction motor 32 and its associated motor shaft 34. Linear induction motors are commercially available from various OEM's, such as, for example, Innovex, Inc. Linear induction motors typically are rated by their stall force, which means that a representative linear induction motor can extend and retract the motor shaft with such a driving force that it takes, for example, 20 lbs. (9 kg) of force, or perhaps 100 lbs. (45 kg) in another motor, in opposition to the driving force to stall the movement of the motor shaft.

The motor shaft 34 is driven between an extended position (shown in FIGS. 1 and 2) and a retracted position (not shown). The motor shaft 34 is formed with a pair of sockets 36 and 38 near each opposite end. The socket 36 on the left end carries a pin or abutment member 40 (whose functions will be more fully explained below) while the socket 38 on the right end is unused.

The apparatus 10 further includes a pair of spaced cam members 42. The cam members 42 can be stamped from sheet metal in generally an S-shaped configuration. The cam members 42 are disposed on opposite sides of the path of extension of the shaft of linear induction motor 32. Cam members 42 have lower ends formed with a mounting-hole 44 by which the cam members 42 are pivotally connected to turned down flanges 46 of base plate 18, to pivot about a fixed axis. The cam members 42 have upper halves that with parallel inner and outer cam surfaces 52 and 54 defining an enclosed slot 56 in each cam member 42. The slots 56 of the two cam members 42 are identical, each including a straight section 58 joined to an inclined or curved section 60.

The cam members 42 are interconnected with the couple 30 that engages the toggle, handle or other operator 12, via a pair of rigid links 62, which are pivotally connected to the cam members 42 and couple 30, respectively. For this purpose, the opposite ends of links 62 can be affixed by a screw, rivet arrangement or similar fastener to the cam members and to the ends of pin 26 of the couple.

The motor shaft pin or abutment member 40 that extends through the left socket 36 in the motor shaft 34, has opposite end portions partly protruding into slots 56 in the cam members 42. These opposite end portions define abutment surfaces that bear against one or the other of the cam surfaces 52, 54 in the curved section 60 of the slots 56. The abutment member 40, cam members 42 and rigid links 62 cooperatively constitute a mechanism 70 interconnecting the socket 36 on the motor shaft 34 with the couple 30 on the toggle or handle 12. The mechanism 70 functions such that changes in position in the motor shaft 34 generally induce changes in position in the toggle or handle 12 via the couple 30.

The figures show the motor shaft 34 in an extreme extended position. The toggle or handle 12 of the molded-case circuit breaker 14 is correspondingly positioned to one of its extreme end positions. Circuit switches typically have two operative positions, namely closed and open. Circuit breakers may have four positions. In an ON position, the circuit breaker 14 is closed (e.g., as shown in the figures). In a TRIPPED position, the circuit breaker is open, but the toggle or handle has moved to an intermediate position between the ON and an OFF position. In a RESET position, the toggle or handle is forced beyond the OFF position to pre-load internal springs inside of the breaker, but the toggle or handle is biased to normally return to a stable OFF position.

The linear induction motor 32 can be controlled to drive the motor shaft 34 from the extreme extended position (i.e., as shown in FIGS. 1 and 2) toward an extreme retracted position (to the right in the figures) under control of various kinds of remote control arrangements that are known in the art, which are not illustrated, and are not part of the invention. The remote controller may be operated manually by a switch means, or automatically by programmable devices or by a state switching arrangement whereby a number of related switches are caused to change state in a coordinated manner. As the motor shaft 34 moves to the right, the abutment member 40 drives against the inner cam surfaces 52 and induces the cam members 42 to pivot clockwise in the figures around an axis at opening 44. The rigid links 62 correspondingly sweep generally from left to right in the figures, urging the couple to the right in its slot and displacing the toggle or handle 12 clockwise. Switch 14 preferably is open when the motor shaft 34 is in the extreme extended position. Switch 14 is closed when the abutment member 40 is positioned at the cusp 72 between the inclined or curved section 60 of the slot 56 and the straight section 58.

The apparatus 10 can be configured to operate the circuit breaker 14 such that the toggle or handle 12 is positioned in the RESET position when the abutment member 40 is positioned at the cusp 72. In another configuration, the toggle or handle 12 is correspondingly positioned to the OFF position when the abutment member 40 is positioned at cusp 72. In this latter configuration, the motor 32 can be controlled to continue to retract the motor shaft 34 (right in the figures) until the abutment member 40 eventually bears against the right end 74 of the slots 56, and then retract a small distance further, to pivot the cam members 42 clockwise, thereby moving the toggle or handle 12 of the circuit breaker 14 from the OFF position to the RESET position.

Straight section 58 of slot 56 provides for a lost motion or idling action of the mechanism 70. Couple 30 engaging the toggle or handle 12 does not move while motor shaft 34 extends or retracts if abutment member 40 is positioned between cusp 72 and the right end 74, i.e., when member 40 is in the straight part 58 of slots 56. This is useful in that the unopposed displacement of motor 32 along straight part 58 provides time for the motor to accelerate motor shaft 34 when approaching the point at which force will be applied to the couple, e.g., while driving the motor shaft 34 from the extreme retracted position toward the extended position (toward the left in the figures). When the abutment member 40 reaches the cusp 72 at the end of straight section 58 of the slot 56, and enters the inclined or curved section 60 of the slot 56, any further extension of the motor shaft 34 induces a corresponding change in position in the toggle or handle 12 via the couple 30. Similarly, in an embodiment for a multiposition circuit breaker, the shaft accelerates as abutment 40 approaches end 74.

The mechanism 70 is configured to amplify the driving force supplied by the motor 32 by leverage, thereby resulting in an induced force acting on the toggle or handle 12 that preferably is several times greater than the driving force. This force amplification or leverage provided by the mechanism 70 permits a cost-saving reduction in the size of the motor needed to operate the handle or toggle of the circuit breaker. The cost-savings can be significant; for instance, circuit breakers used in demanding applications like power sub-stations may take 150 to 300 lbs. (70 to 140 kg) to displace the toggle or handle. The driver or motor, on the other hand, need not develop a drive force of such magnitude, and a lighter and less expensive motor having a lower stall rating can be used. The proportionate increase in the force at abutment 40 as applied to couple 30, or the "Amplification factor" generally corresponds to a ratio of two distances: namely, the distance between the fixed axis 44 and an axis defined by abutment 40 on the motor shaft 34, divided by the distance between the fixed axis 44 and the pivot point of rigid link 62 on cam member 42.

In the exemplary embodiment shown, this ratio of distances is about three. For a switch or circuit breaker 14 as shown, for example being rated at 600 $V^{MAx}$ for 1200 A continuous, induction motor 32 operates on 110 VAC at about 12 A. The rating of the induction motor 32 is 20 lbs. (9 kg) stall force, which is the force that overcomes the thrust or pull of the motor shaft 34 to bring it to a stop. The time of travel for the motor shaft 34 from the extreme retracted position to the extreme extended position is about 0.6 seconds. The mechanism 70 provides the motor 32 with such leverage that the toggle or handle 12 of the circuit breaker 14 may take more than the twice the rated stall force of the induction motor 32 to operate. Consequently, the motor 32 need not have a rated stall force generally equal to the force required to operate or displace the toggle or handle 12 of the switch 14.

The curved section 60 of the slot 56 is sized and arranged relative to the motor shaft 34 such that the motor shaft 34 attacks the curved section 60 of the slot 56 along such an axis that the motor shaft 34 generally coincides with the local radius of curvature for the curved section 60, for all orientations of the cam members 42, so that forces perpendicular to the motor shaft 34 are minimized. Put differently, the motor shaft 34 defines an axis that generally intersects a point on the curved section 60 along the local radius of curvature for that point on the curved section 60. The shape and arrangement of the curved section 60 minimizes the vertical components of the contact forces between the abutment member 40 and the cam surfaces 52, 54 in the curved section 60. This minimizes upward and downward forces on the end 36 of the motor shaft 34, to reduce and minimize friction, wear and mounting demands that would otherwise occur by motor shaft 34 binding in the central tunnel 76 of the linear induction motor 32 due to forces perpendicular to the axis of shaft 34, especially near the end of the shaft stroke as shown in the drawings.

Induction motor 32 can controlled from signals generated internally by circuit breaker 14, e.g. , by limit switches arranged to provide signals or to switch power. For example, micro switches in breaker 14 can be provided to sense the position of the toggle or handle of the circuit breaker 14, and to signal a relay arrangement or a programmable device, which may also have other inputs and determines whether to apply power to motor 32 for operating motor 32 to achieve some predetermined function such as the coordinated operation of the breaker with other devices.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. Apparatus for displacing a toggle or rocker-type actuator of a circuit switch, the circuit switch being mounted to a mounting structure, the apparatus comprising:

a couple engageable on the toggle or rocker-type actuator of the circuit switch;

a controllable device, mounted fixed relative the mounting structure, for supplying a driving force, the controllable device having an arm formed with an attachment-fixture and being controllable to alternately drive and stop the arm, the arm carrying the attachment-fixture through various positions relative to the circuit switch repeatably between a first position and a second position; and, a mechanism interconnecting the arm of the controllable device with the couple on the toggle or rocker-type actuator of the circuit switch;

the mechanism comprising a pivotal cam member mounted to pivot about a fixed axis relative the mounting structure, a rigid link extending between opposite ends pivotally connected to the couple and the cam member respectively, and, an abutment member attached to the attachment-fixture on the arm;

wherein the cam member is formed with an elongated slot as defined between spaced edges, and, the abutment member is arranged with portions partly occupying the slot and abuttable against one of said edges;

wherein the slot comprises an active section, and the arm and cam member are cooperatively arranged such that while the abutment member occupies the active section, operation of the controllable device effects driving the abutment member to attack one of the edges of the slot such that the abutment member simultaneously traverses said edge and induces angular changes in position of the cam member, which angular changes in position of the cam member induce corresponding changes in position of the couple on the toggle or rocker-type actuator of the circuit switch via the rigid link; and, the mechanism being sized and arranged such that the first and second positions for attachment-fixture correspond to open and closed positions respectively for the circuit switch, whereby operation of the controllable device permits operation of the circuit switch.

2. The apparatus of claim 1, wherein the cam member is arranged such that the slot generally is radially further away from the fixed pivot axis than is the pivotal connection with the rigid and thus the cam member amplifies the driving force supplied from the controllable device as applied to the couple by a factor such that the apparatus can operate the toggle or rocker-type actuator of the circuit switch at an operating force greater than the driving force.

3. The apparatus of claim 1, wherein the slot includes an idling section in addition to the active section, the arm and cam member being further arranged such that while the abutment member occupies the idling section, operation of the controllable device effects the abutment member to traverse the edges of the slot while the cam member remains angularly stationary despite movement of the abutment member in the idling section of the slot.

4. The apparatus of claim 1, wherein the controllable device positively drives the abutment member in straight line motion, and, the active section is inclined relative to a straight axis defined by the motion of the abutment member.

5. The apparatus of claim 4, wherein the inclined active section is also curved.

6. The apparatus of claim 3, wherein the controllable device positively drives the abutment member in straight line motion, and the idling section is straight.

7. The apparatus of claim 1, further comprising a spaced other and opposite cam member.

8. The apparatus of claim 7, wherein the abutment member comprises an elongated pin extending transversely between the cam members and being maintained by the arm in a generally parallel relationship with the fixed axis, the elongated pin having spaced apart portions partly disposed in the respective slots of the cam members.

9. The apparatus of claim 8, wherein the controllable device comprises a linear induction motor and the arm comprises a shaft coupled to the motor for operation such that the first and second positions correspond to a relatively extended and retracted position, respectively, said attachment-fixture comprising a hole extending radially through the shaft, which hole is sized for carrying the elongated pin perpendicularly to the shaft.

10. The apparatus of claim 1, wherein the couple comprises a receptacle engageable over the toggle or rocker-type actuator of a given circuit switch chosen from one of a circuit interrupter, a motor contactor, a molded-case circuit switch, and a molded-case circuit breaker.

11. Apparatus for displacing a toggle or rocker-type actuator of a circuit switch, the apparatus comprising:

a couple engageable on the toggle or rocker-type actuator of the circuit switch;

motive means for supplying a drive input, comprising an arm formed with an attachment-fixture and being operable to alternately drive and stop the arm, the arm carrying the attachment-fixture in straight line motion through various positions relative to the circuit switch reversibly between opposite extreme positions; and, a mechanism interconnecting the arm of the motive means with the couple on the toggle or rocker-type actuator of the circuit switch;

the mechanism comprising a pivotal cam member mounted to pivot about a fixed axis, a rigid link extending between opposite ends pivotally connected to the couple and the cam member respectively, and, an abutment member attached to the attachment-fixture on the arm;

wherein the cam member has spaced and elongated cam surfaces defining a slot therebetween, the abutment member being arranged with portions partly occupying the slot and abuttable alternately against one and the other of said cam surfaces;

wherein the slot has an inclined section that is inclined relative to a straight axis defined by the motion of the abutment member, and the arm and cam member are cooperatively arranged such that while the abutment member occupies the inclined section, operation of the motive means effects driving the abutment member to attack one of the cam surfaces of the slot such that the abutment member simultaneously traverses said one cam surface and induces angular changes in position of the cam member, which results in corresponding changes in position of the couple on the toggle or rocker-type actuator of the circuit switch via the rigid link; and, wherein the mechanism is sized and proportioned such that operation of the motive means permits operation of the toggle or rocker-type actuator of the circuit switch, between open and closed positions for the circuit switch.

12. The apparatus of claim 11, wherein the slot includes an idling section joined to the inclined section; the abutment member cooperates with the idling section such that the couple idles despite changes in position of the drive input.

13. The apparatus of claim 11, wherein the inclined section is also curved.

14. The apparatus of claim 11, wherein the couple comprises a receptacle engageable over the toggle or rocker-type actuator of a given circuit switch chosen from one of a circuit interrupter, a motor contactor, a molded-case circuit switch, and a molded-case circuit breaker.

* * * * *